US009963928B2

(12) United States Patent
Zack

(10) Patent No.: US 9,963,928 B2
(45) Date of Patent: May 8, 2018

(54) SYSTEM FOR CONSTRUCTION OF A HABITABLE ROOM

(71) Applicant: OPENWALL O.W., Orleans (FR)

(72) Inventor: Patrick Zack, Paris (FR)

(73) Assignee: OPENWALL O.W., Orleans (FR)

( * ) Notice: Subject to any disclaimer, the term of this patent is extended or adjusted under 35 U.S.C. 154(b) by 0 days. days.

(21) Appl. No.: 15/541,416

(22) PCT Filed: Dec. 30, 2015

(86) PCT No.: PCT/FR2015/000244
§ 371 (c)(1),
(2) Date: Jul. 3, 2017

(87) PCT Pub. No.: WO2016/110614
PCT Pub. Date: Jul. 14, 2016

(65) Prior Publication Data

US 2018/0030774 A1 Feb. 1, 2018

(30) Foreign Application Priority Data

Jan. 6, 2015 (FR) ..... 15 00008

(51) Int. Cl.
*E06B 1/02* (2006.01)
*E06B 3/36* (2006.01)
(Continued)

(52) U.S. Cl.
CPC ..... *E06B 1/02* (2013.01); *E05D 7/081* (2013.01); *E06B 3/325* (2013.01); *E06B 3/36* (2013.01); *E05Y 2900/132* (2013.01)

(58) Field of Classification Search
CPC ... E06B 1/02; E06B 3/36; E06B 3/325; E05D 7/081; E05Y 2900/132
See application file for complete search history.

(56) References Cited

U.S. PATENT DOCUMENTS 2,557,753 A * 6/1951 Mitchell ..... E05D 15/24 160/229.1
3,531,824 A * 10/1970 Hagendoorn ..... E05D 11/06 16/222

(Continued)

FOREIGN PATENT DOCUMENTS

DE 20 2010 007095 U1 9/2010
WO 2010/064901 A1 6/2010

OTHER PUBLICATIONS

International Search Report, dated May 3, 2016, from corresponding PCT/FR2015/000244 application.

*Primary Examiner* — Paolo Agudelo
(74) *Attorney, Agent, or Firm* — Young & Thompson

(57) ABSTRACT

Disclosed is a system for constructing a habitable room or the like including at least one door, walls, and door mount to pivot relative to the two walls about an axis in such a manner as to be suitable for occupying at least two positions, namely a "closed" position in which the door is contained in the plane of the first wall, and an "open" position in which the door is not. The system includes a through opening and a setback each presenting a shape substantially complementary to the door and made respectively in the first and second walls, and together having a common zone, with the axis in the zone, and arranged in such a manner that, on pivoting about the axis, the door in its first position it is integrated in the opening, and when it is in its second position, it is contained in the setback.

20 Claims, 2 Drawing Sheets

(51) Int. Cl.
*E06B 3/32* (2006.01)
*E05D 7/081* (2006.01)

(56) References Cited

U.S. PATENT DOCUMENTS 3,932,913 A * 1/1976 Johnson ..... E05D 3/022 16/244
4,704,766 A * 11/1987 Almestad ..... E05D 5/065 16/236
5,718,089 A * 2/1998 Dakin ..... A63H 33/008 446/110
2016/0177619 A1* 6/2016 Aykas ..... E05D 1/00 16/402

* cited by examiner

Fig. 3
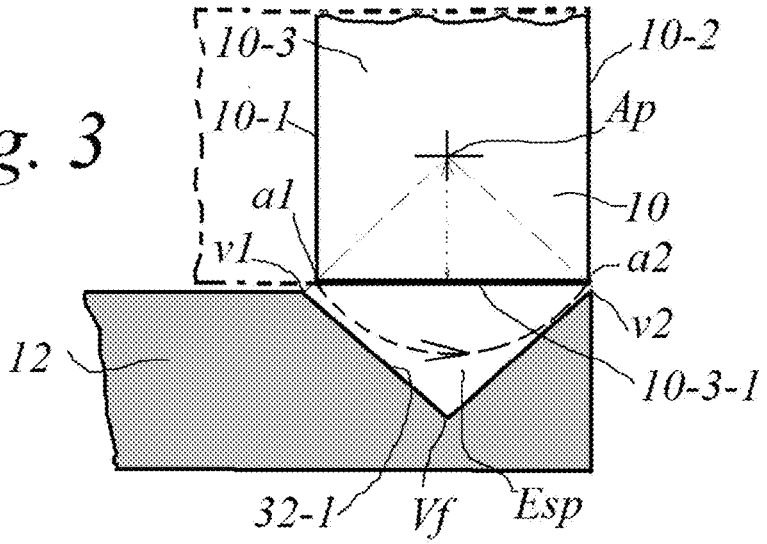
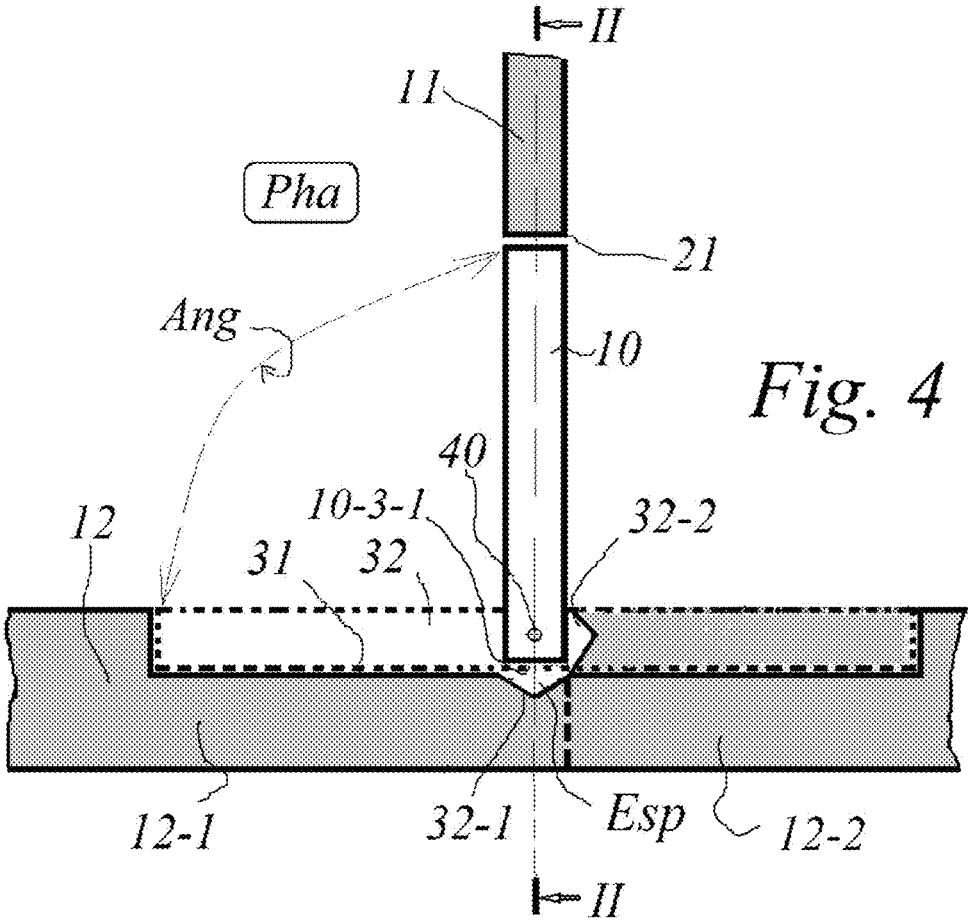
Fig. 4

SYSTEM FOR CONSTRUCTION OF A HABITABLE ROOM

The present invention relates to systems for constructing a habitable room or the like, the system comprising at least one door and first and second contiguous walls forming a non-zero angle between them, and means for mounting the door to pivot relative to the two walls about a pivot axis in such a manner that it is suitable for occupying at least two positions, namely a "closed", first position in which it lies in the plane of the first wall, and an "open" position in which it does not lie in that plane.

Such systems are already known, such as those described in DE 20 2010 007 095 and WO 2010/064901, in which the door is mounted on hinge pins that generally project from the plane of the door, which is not very attractive, in particular when the door is in its open position, since it is then folded back against the second wall, lying in front of it. Furthermore, in certain circumstances, it is found that when the door goes from its open position to its closed position, or vice versa, and when it reaches one or the other of these positions, a disagreeable banging noise occurs which is commonly referred to as "the door slamming". In addition, the systems described in those two prior documents relate to doors that close a passage that is defined solely between two parallel walls.

Thus, an object of the present invention is to provide a system for constructing a habitable room or the like having at least one door and first and second contiguous walls, and that mitigates to a large extent the above-emphasized drawbacks and that also presents appearance that is undeniably attractive.

More precisely, the present invention provides a system for constructing a habitable room or the like including at least one door, and first and second contiguous walls forming a non-zero angle Ang between them, and as defined in particular in accompanying claim 1.

Other characteristics and advantages of the present invention appear from the following description given with reference to the accompanying drawings by way of non-limiting illustration, and in which:

FIG. 3 is on a larger scale than FIGS. 1 and 2 and shows the encircled portion Cr of FIG. 1, serving to explain more clearly preferred characteristics of the system of the invention; and FIG. 4 is a diagram of another embodiment of a construction system of the invention, the section plane II-II of FIG. 2 applying likewise to the embodiment shown in FIG. 4.

Figure 1:
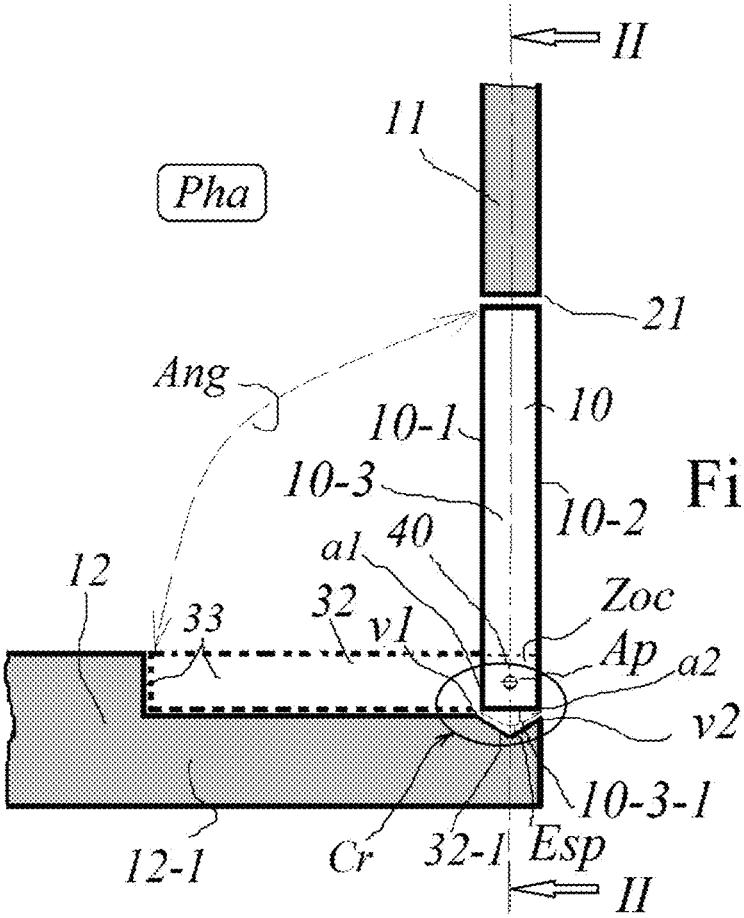
FIGS. 1 and 2 are diagrams showing a first embodiment of a system of the invention for constructing a habitable room or the like having at least one door and first and second contiguous walls, FIG. 1 being a plane section view seen from above, defined on I-I in FIG. 2, and FIG. 2 being a plane section view seen from the side, defined on II-II of FIG. 1.

To begin with it is specified that in the figures the same references are used to designate the same elements, regardless of the figure in which the elements appear and regardless of the way in which the elements are represented. Likewise, if elements are not specifically referenced on one of the figures, their references can easily be found by referring to another figure.

It is also specified that the accompanying figures present two embodiments of the invention, but that other embodiments can exist that satisfy the definition of the invention.

It is also specified that in the present description, if the adverb "substantially" is associated with a qualifier of any given means, then the qualifier should be understood either strictly or approximately.

With reference to the accompanying figures, the present invention relates to a system for constructing a habitable room Pha or the like, e.g. in a house, an apartment, etc . . . .

The system includes at least one door 10, first and second contiguous walls 11 and 12 forming a non-zero angle Ang between them, generally, but not necessarily, a right angle, and means 40 for mounting the door 10 to pivot relative to these two walls 11, 12 about a pivot axis Ap so that it is capable of occupying at least two positions, namely a "closed", first position, shown in continuous lines in the figures, where the door lies in the plane of the first wall 11, and an "open", second position, drawn in dashed lines in the figures, where the door does not lie in that plane.

In the invention, the system has a through opening and a setback 32, both of which present a shape substantially complementary to the shape of the door 10, and which are made respectively in the first wall 11 and in the second wall 12, sharing a common zone Zoc, said pivot axis Ap being situated in said common zone Zoc and the common zone being arranged in such a manner that on pivoting about the pivot axis Ap, when the door 10 is in its first position it is incorporated in the through opening 21, and when it is in its second position it is contained in the setback 32, these first and second positions being shown in the figures respectively in continuous lines and in dashed lines.

In an advantageous embodiment, when the door 10 is in the form of a plate that is generally substantially a rectangular parallelepiped, thus having two substantially parallel opposite faces 10-1, 10-2 and an edge face 10-3 interconnecting the two opposite faces, the portion of the wall 32-1 of the setback 32 that faces the portion 10-31 of the edge face 10-3 when the door is in its first position presents a concave shape defining same minimum space Esp between the wall portion 32-1 of the setback and the edge face portion 10-3-1 so that, on pivoting about the pivot axis Ap, the door 10 is free to pass from its first position to its second position, and vice versa.

As can be seen in FIG. 3, it is advantageous for the position of the pivot axis Ap to be defined in such a manner as to be at equal distances from the two opposite faces 10-1 and 10-2 and from the portion 10-3-1 of the edge face 10-3 so as to be able to pivot under the best conditions, as explained below, this distance thus being equal to half the thickness of the door 10.

In preferred manner, the above-defined concave shape is substantially V-shaped, as shown, with the distance between the free ends v1, v2 of the V-shape being substantially equal to the thickness of the edge face portion 10-3-1, with the distance between the pivot axis Ap and each of the free ends v1, v2 of the V-shape being slightly greater than the distance between the pivot axis Ap and the two edges a1, a2 defined respectively between the two opposite faces 10-1, 10-2 and the edge face portion 10-3-1, and with the distance between the pivot axis Ap and the bottom Vf of the V-shape being not less than the thickness of the edge face portion 10-3-1, and preferably a little greater. These characteristics are shown clearly in FIG. 3 and can readily be deduced therefrom.

In a preferred embodiment, the wall portion 32-1 of the setback 32 that faces the edge face portion 10-3-1 when the door is in its first position is constituted by a metal section bar, of the type that is easily found in the trade and that can easily be incorporated in the second wall 12 while it is being constructed, e.g. being used as a portion of formwork or as a reference plane when constructing the wall by using plates or the like.

As mentioned above, on pivoting about the pivot axis Ap, the door 10 needs to be capable of passing from its first position to its second position, and vice versa. Thus, the system includes means 40 for mounting the door 10 to pivot about the pivot axis Ap, which means are most advantageously constituted by two pivots 40-1, 40-2 (FIG. 2) mounted to co-operate with the door 10 so that they are suitable for pivoting respectively in two complementary seats formed respectively in two opposite portions 21-1, 21-2 of the side wall of the through opening 21. Assembling such a pivot with the associated seat is itself known and is not described in greater detail herein, purely for the purpose of simplifying the present description.

At least for certain construction systems of the invention that are for particular purposes, it is also preferable for the system to further include blocking/unblocking means to block the door 10 when it is in its first position, and even when it is in its second position, and also to unblock the door. These blocking/unblocking means may be constituted in various ways, for example by a lock or the like, or by a spring catch. They are mounted in known manner to co-operate between the door 10 and the side wall of the through opening 21 and/or between the door and the wall of the setback 32.

It is specified that the shape of the portion 10-3-1 of the edge face 10-3 should be selected from the following shapes: convex, concave, plane.

In more preferable manner, and particularly from an industrial point of view, the portion 10-3-1 of the edge face 10-3 is plane, being substantially parallel to the pivot axis Ap and perpendicular to the two opposite faces 10-1 and 10-2.

The construction system of the invention, an embodiment of which is described above with reference to FIGS. 1 to 3, presents advantages that are not negligible compared with prior art systems. One of these advantages is as follows: when the door goes from its closed position to its open position, it does not slam. Specifically, when it enters into the setback 32, a layer or cushion of air is formed that damps entry of the door, with the air initially being compressed, and subsequently escaping slowly through the gaps that always exist in practice between the edge face 10-3 of the door 10 and the side wall 33 of the setback 32.

The same applies when the door goes from its open position to its closed position. It still does not slam, even though a small clicking sound may be produced by the catch engaging.

However the construction system of the invention also presents another advantage, in particular in terms of appearance. This advantage can be seen on examining the figures.

Specifically, whether it is in its open position or its closed position, because of the structure of the system, the door may be accurately in alignment with the faces of the walls 11 and 12, without standing proud therefrom as in most prior art systems.

Figure 2:
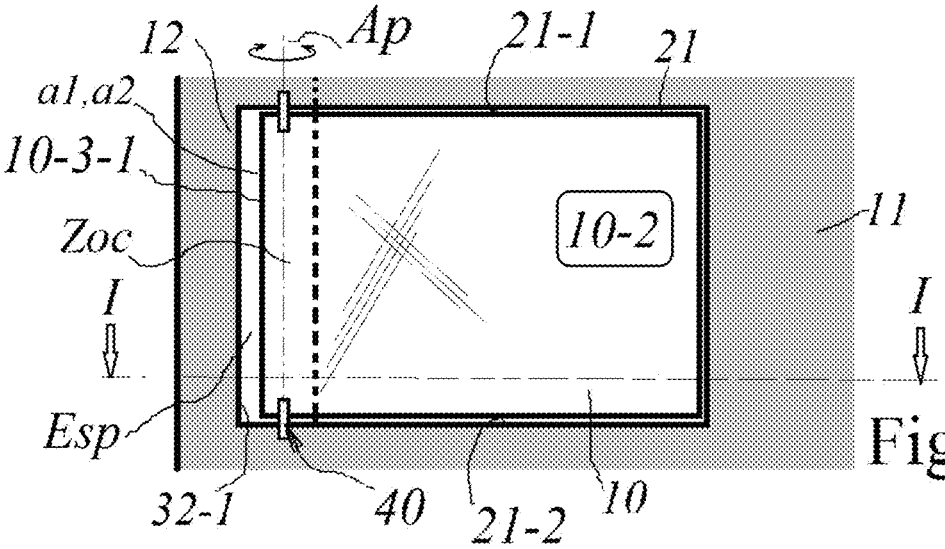

FIG. 4 shows another particular embodiment of the system of the invention, which is not described specifically herein since it can be deduced without any difficulty from the above description of the embodiment of FIGS. 1 to 3. In addition, in the above-described embodiments, the angle Ang is a right angle, but it should naturally be understood that it may be an angle other than a right angle.

The invention claimed is:

1. A system for constructing a habitable room (Pha) including at least one door (10), and first and second contiguous walls (11, 12) forming a non-zero angle (Ang) between them, and means (40) for mounting said door (10) to pivot relative to the two walls about a pivot axis (Ap) such that said door occupies at least two positions, namely a "closed", first position in which the door is contained in the plane of the first wall, and an "open", second position in which the door is not contained in said plane, the system comprising a through opening (21) and a setback (32) each presenting a shape substantially complementary to the shape of said door (10) and being made respectively in the first wall (11) and in the second wall (12), and together having a common zone (Zoc), said pivot axis (Ap) being situated in said common zone (Zoc) and the common zone being arranged in such a manner that, on pivoting about said pivot axis (Ap), when said door (10) is in said first position it is integrated in said through opening (21), and when it is in said second position, it is contained in said setback (32).

2. A system according to claim 1, when said door (10) is in the form of a plate generally in the shape of a rectangular parallelepiped and thus comprising two substantially parallel opposite faces (10-1, 10-2) and an edge face (10-3) connecting together the two opposite faces, wherein a wall portion (32-1) of said setback (32) that faces a portion (10-3-1) of the edge face (10-3) when the door is in said first position presents a concave shape defining a space (Esp) between said wall portion (32-1) of said setback and said edge face portion (10-3-1) so that, on pivoting about the pivot axis, said door is free to pass from its first position to its second position, and vice versa.

3. A system according to claim 2, wherein a position of said pivot axis (Ap) is defined so as to be at equal distances from the two opposite faces (10-1, 10-2) and from said edge face portion (10-3-1).

4. A system according to claim 2, wherein the concave shape is substantially V-shaped, the distance between two free ends (v1, v2) of said V-shape being substantially equal to the thickness of said edge face portion (10-3-1), the distance between the pivot axis (Ap) and each of the two free ends of the V-shape being slightly greater than the distance between said pivot axis (Ap) and two edges defined respectively between the two opposite faces (10-1, 10-2) and the edge face portion (10-3-1), and the distance between said pivot axis (Ap) and a bottom (Vf) of the V-shape being not less than the thickness of said edge face portion (10-3-1).

5. A system according to claim 4, wherein the wall portion (32-1) of said setback (32) that faces said edge face portion (10-3-1) when the door is in said first position is constituted by a metal section bar.

6. A system according to claim 1, wherein the means (40) for mounting said door (10) to pivot about the pivot axis (Ap) are constituted by two pivots (40-1, 40-2) mounted to co-operate with said door (10) in such a manner as to be suitable for pivoting respectively in two complementary seats formed respectively in two opposite portions (21-1, 21-2) of the side wall of said through opening (21).

7. A system according to claim 1, wherein the system includes blocking/unblocking means suitable for blocking said door (10) when it is at least in said first position, and for unblocking it.

8. A system according to claim 7, wherein the blocking/unblocking means are constituted by either one of the following means: a lock, a spring catch; these means being mounted to co-operate between said door (10) and said side wall of said through opening (21).

9. A system according to claim 2, wherein said edge face portion (10-3-1) presents a shape selected from the following shapes: convex, concave, plane.

10. A system according to claim 9, wherein said edge face portion (10-3-1) is plane, being substantially parallel to said pivot axis (Ap) and perpendicular to the two opposite faces (10-1, 10-2).

11. A system according to claim 3, wherein the concave shape is substantially V-shaped, the distance between two free ends (v1, v2) of said V-shape being substantially equal to the thickness of said edge face portion (10-3-1), the distance between the pivot axis (Ap) and each of the two free ends of the V-shape being slightly greater than the distance between said pivot axis (Ap) and the two edges defined respectively between the two opposite faces (10-1, 10-2) and the edge face portion (10-3-1), and the distance between said pivot axis (Ap) and the bottom (Vf) of the V-shape being not less than the thickness of said edge face portion (10-3-1).

12. A system according to claim 2, wherein the means (40) for mounting said door (10) to pivot about the pivot axis (Ap) are constituted by two pivots (40-1, 40-2) mounted to co-operate with said door (10) in such a manner as to be suitable for pivoting respectively in two complementary seats formed respectively in two opposite portions (21-1, 21-2) of the side wall of said through opening (21).

13. A system according to claim 3, wherein the means (40) for mounting said door (10) to pivot about the pivot axis (Ap) are constituted by two pivots (40-1, 40-2) mounted to co-operate with said door (10) in such a manner as to be suitable for pivoting respectively in two complementary seats formed respectively in two opposite portions (21-1, 21-2) of the side wall of said through opening (21).

14. A system according to claim 4, wherein the means (40) for mounting said door (10) to pivot about the pivot axis (Ap) are constituted by two pivots (40-1, 40-2) mounted to co-operate with said door (10) in such a manner as to be suitable for pivoting respectively in two complementary seats formed respectively in two opposite portions (21-1, 21-2) of the side wall of said through opening (21).

15. A system according to claim 5, wherein the means (40) for mounting said door (10) to pivot about the pivot axis (Ap) are constituted by two pivots (40-1, 40-2) mounted to co-operate with said door (10) in such a manner as to be suitable for pivoting respectively in two complementary seats formed respectively in two opposite portions (21-1, 21-2) of the side wall of said through opening (21).

16. A system according to claim 2, wherein the system includes blocking/unblocking means suitable for blocking said door (10) when it is at least in said first position, and for unblocking it.

17. A system according to claim 3, wherein the system includes blocking/unblocking means suitable for blocking said door (10) when it is at least in said first position, and for unblocking it.

18. A system according to claim 4, wherein the system includes blocking/unblocking means suitable for blocking said door (10) when it is at least in said first position, and for unblocking it.

19. A system according to claim 5, wherein the system includes blocking/unblocking means suitable for blocking said door (10) when it is at least in said first position, and for unblocking it.

20. A system according to claim 6, wherein the system includes blocking/unblocking means suitable for blocking said door (10) when it is at least in said first position, and for unblocking it.

* * * * *